US008162718B2

(12) United States Patent
Chen

(10) Patent No.: US 8,162,718 B2
(45) **Date of Patent: *Apr. 24, 2012**

(54) BRA PAD

(76) Inventor: Hui-Mei Chen, Shulin (TW)

( * ) Notice: Subject to any disclaimer, the term of this patent is extended or adjusted under 35 U.S.C. 154(b) by 344 days.

This patent is subject to a terminal disclaimer.

(21) Appl. No.: 12/467,443

(22) Filed: May 18, 2009

(65) Prior Publication Data

US 2009/0227181 A1 Sep. 10, 2009

Related U.S. Application Data

(63) Continuation-in-part of application No. 11/942,017, filed on Nov. 19, 2007, now Pat. No. 7,618,304.

(51) Int. Cl.
*A41C 3/00* (2006.01)

(52) U.S. Cl. ..... 450/38; 450/57; 450/54

(58) Field of Classification Search ..... 450/38, 450/37, 39, 54–58; 2/267, 268, 8
See application file for complete search history.

(56) References Cited

U.S. PATENT DOCUMENTS

| | | | | |
|---|---|---|---|---|
| 3,986,213 | A * | 10/1976 | Lynch | 623/8 |
| 5,340,352 | A * | 8/1994 | Nakanishi et al. | 450/57 |
| 5,522,892 | A * | 6/1996 | Lin | 623/7 |
| 5,733,335 | A * | 3/1998 | Ishikawa et al. | 623/7 |
| 6,811,463 | B2 * | 11/2004 | Martz | 450/57 |
| 6,857,932 | B2 * | 2/2005 | Chen | 450/38 |
| 7,144,296 | B2 * | 12/2006 | Chen et al. | 450/81 |

* cited by examiner

*Primary Examiner* — Gloria Hale
(74) *Attorney, Agent, or Firm* — Chun-Ming Shih

(57) ABSTRACT

A bra pad includes a thermoplastic polyurethane (TPU) film, a silicone gel layer and a cloth layer. The silicone gel layer is formed in a concave shape. On the edge of the silicone gel layers is attached to TPU films and the cloth layers. The silicone gel layers is semi-secured on the edge of the cloth layers to form the bar pad structure. Between the silicone gel layer and the TPU film, there is formed a first space and between the silicone gel layer and the cloth layer, there is formed a second space. The present bra pad employs the silicone gel material layer to enhance the softness and comfort. With the first and second space between the thermoplastic polyurethane (TPU) film, the silicone gel layer, and the cloth layer, the bra pad has effective breathing capability and heat-dissipating capability.

4 Claims, 5 Drawing Sheets

BRA PAD

RELATED APPLICATIONS

This application is a continuation-in-part of U.S. patent application Ser. No. 11/942,017, filed on Nov. 19, 2007 now U.S. Pat. No. 7,618,304.

BACKGROUND OF THE INVENTION

1. Field of the Invention

The present invention relates to bra pads, and more specifically, to a bra pad made of a combination combined selectively from materials selected from a group consisting of thermoplastic polyurethane (TPU) films, silicone gel layers, and cloth layers. The bra pad is semi-secured to have effective breathing capability and heat-dissipating capability with light weight, excellent tactility and velvet feature.

2. Description of the Related Art

A conventional bra pad is manufactured by filling liquid-state silicone gel into a chamber formed by a TPU film, and further by solidifying the liquid-state silicone gel. The conventional bra pad may be used for users by cooperating with a bra. The conventional bra pad is a finished product, however, the conventional bra pad has some disadvantages described as following:

1. The conventional bra pad is entirely made of silicone gel, thus it is very weighty, and tends to increase load of the users.
2. Since the conventional bra pad is very weighty, when the users carry the conventional bra pad for a long time or in sport, sweat or heat generated from the users cannot be dissipated effectively, thus the breathe capability and the heat-dissipating capability thereof is bad. Therefore, the conventional bra pad is not favored by the users.

To solve the above problems, another conventional bra pad is manufactured by adding vesicant into the liquid-state silicone gel to decrease the weight of the conventional bra pad. However, since the specific gravity of the vesicant is less than 1, the vesicant tends to float in the silicone gel and congregate together. Thus the vesicant is distributed nonuniformly. The conventional bra pad has a bad tactility and handle, and the conventional bra pad is nonuniform, therefore, it affects greatly the comfort thereof. Also, the breathing capability and heat-dissipating capability problem is not yet effectively resolved.

The inventors of the present invention invent a bra pad through working experience and larger investigation for solving the above problems.

What is needed is a bra pad which can solve the above problems.

BRIEF SUMMARY

An object of the present invention is providing a bra pad, which can effectively resolve the breathing capability and heat-dissipating capability problem and remain a dry and comfortable state when the users carry the bra pad of the present invention for a long time or in sports.

Another object of the present invention is providing a bra pad, which lightens the weight of the bra pad and enhances the softness and comfort, and has an excellent handle. Furthermore, the bra pad of the present invention can make the whole cup elasticity, specific gravity, and active feeling thereof fit with the skin of people, to make the users more comfortable.

The bra pad in accordance with a preferred embodiment of the present invention includes a thermoplastic polyurethane (TPU) film, a silicone gel layer, and a cloth layer. The silicone gel layer is formed in a concave shape. One side of the silicone gel layers is attached to TPU films and the cloth layers. The silicone gel layer is semi-secured on the edge of the cloth layers to form the bar pad structure. Between silicone gel layers and TPU films, there is formed a first space and between TPU films and cloth layers, there is formed a second space. Due to the fact that the silicone gel layer is semi-secured on the edge of the cloth layers to form the bar pad structure, the air will be able to circulate from inside the first and second space to open space. The present bra pad employs the silicone gel material layer to enhance the softness and comfort. With the first and second space between the thermoplastic polyurethane (TPU) films, silicone gel layers, and cloth layers, the bra pad has effective breathing capability and heat-dissipating capability. Furthermore, with the use of cloth layer, the comfort level when wearing is increased even for the users carry for a long time or in sports.

Other objects, advantages and novel features of the invention will become more apparent from the following detailed description when taken in conjunction with the accompanying drawings, in which:

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Reference will now be made to the drawings to describe a preferred embodiment of the present bra pad, in detail.

Figure 1A:
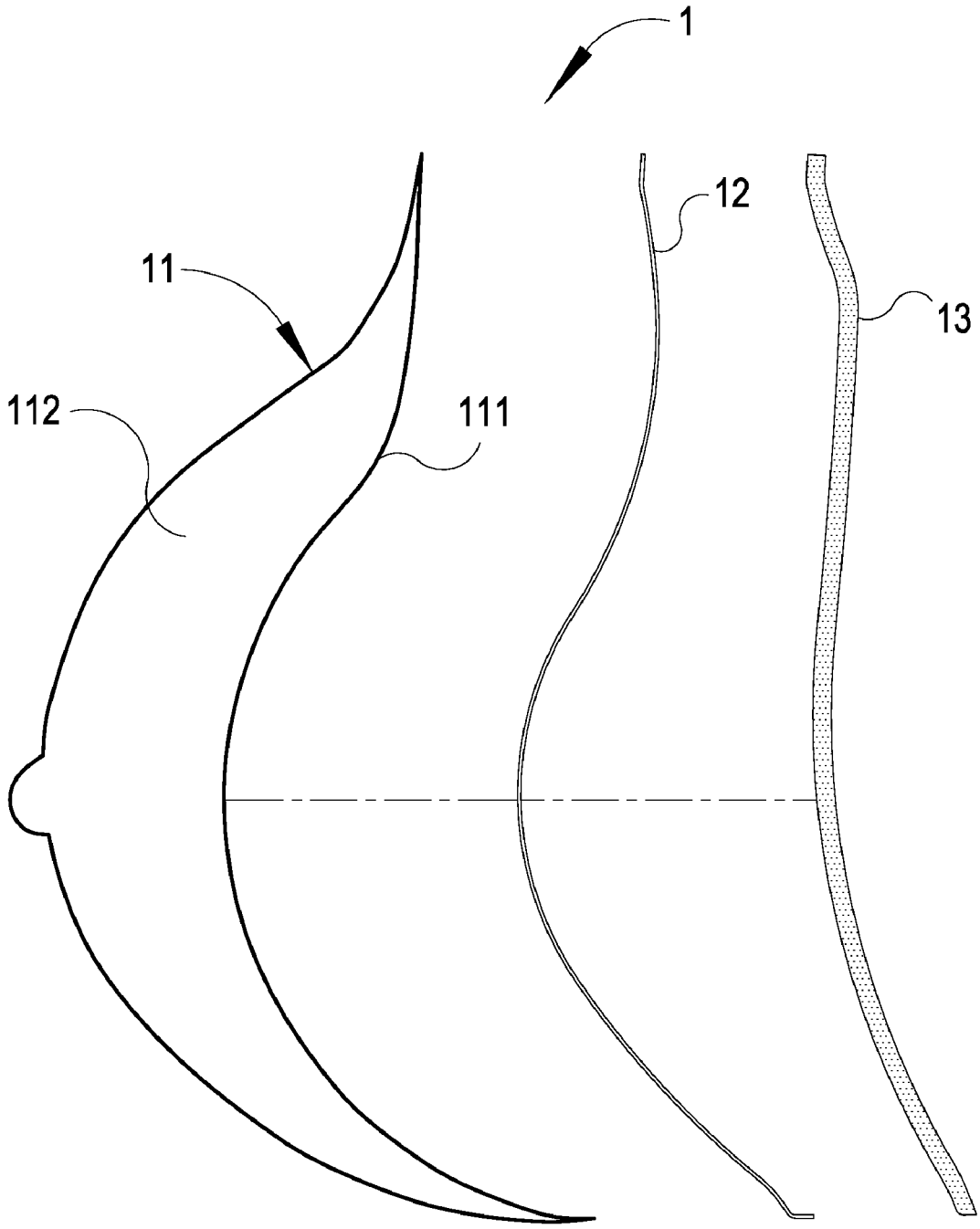
FIG. 1A is a schematic, exploded view of a bra pad of a first preferred embodiment of the present invention.
Figure 1B:
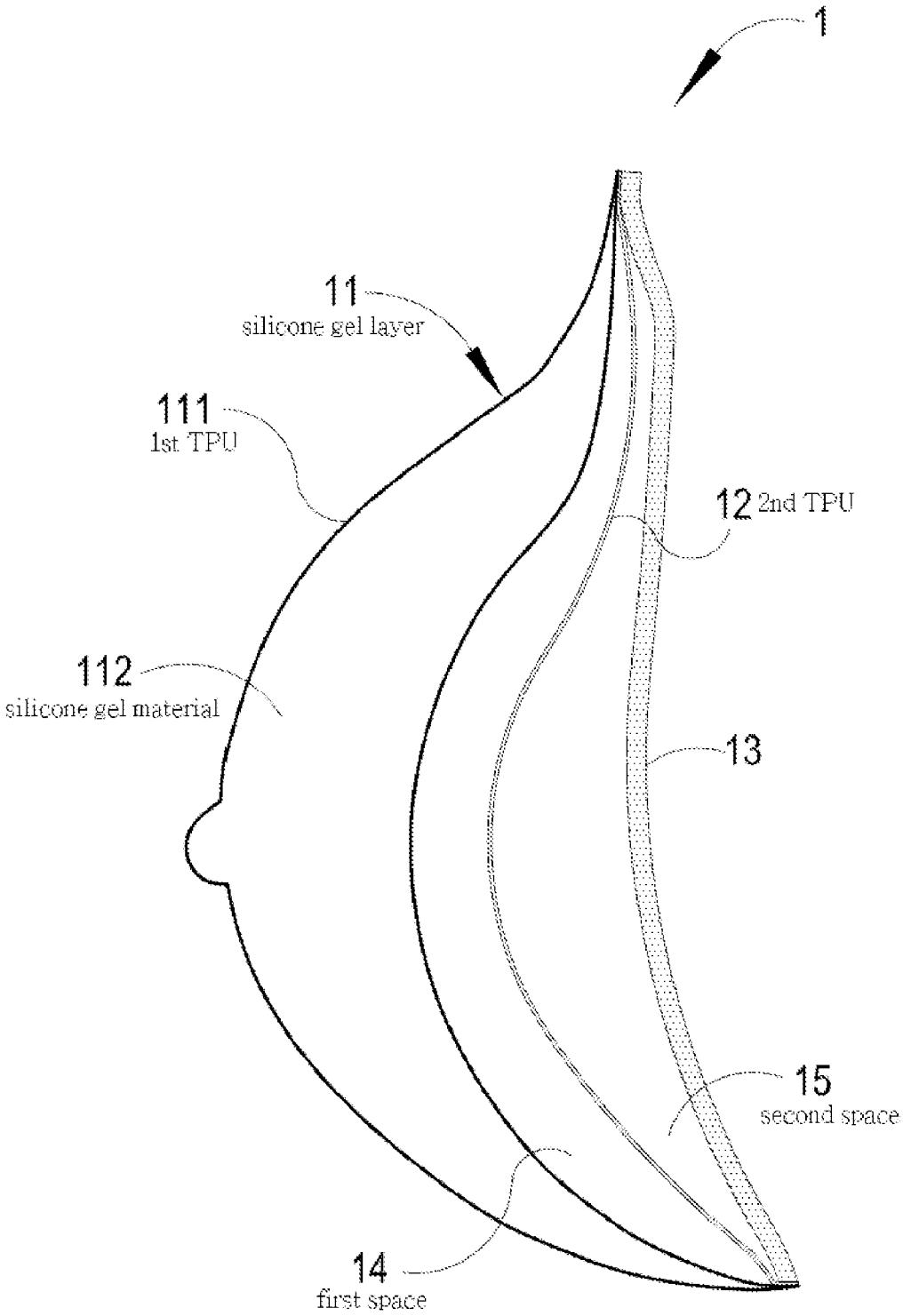
FIG. 1B is a schematic, cross-sectional view of a bra pad of a first preferred embodiment of the present invention.

Referring to FIGS. 1A and 1B, a bra pad 1 in accordance with a first preferred embodiment of the present invention is shown. The bra pad 1 includes: a thermoplastic polyurethane (TPU) film 12, a silicone gel layer 11, and a cloth layer 13.

The silicone gel layer 11 is manufactured by making silicone gel material 112 enclosed by a first thermoplastic polyurethane (TPU) film 111. The silicone gel material 112 may be liquid-state silicone gel, liquid-state silicone rubber, or a silicone gel material filling hollow microspheres therein. The silicone gel layer 11 is manufactured to be a concave cup.

The second thermoplastic polyurethane (TPU) film 12 is placed between the cloth layer 13 and the silicone gel layer 11.

The cloth layer 13 is placed at one side of the thermoplastic polyurethane (TPU) films.

Figure 3:
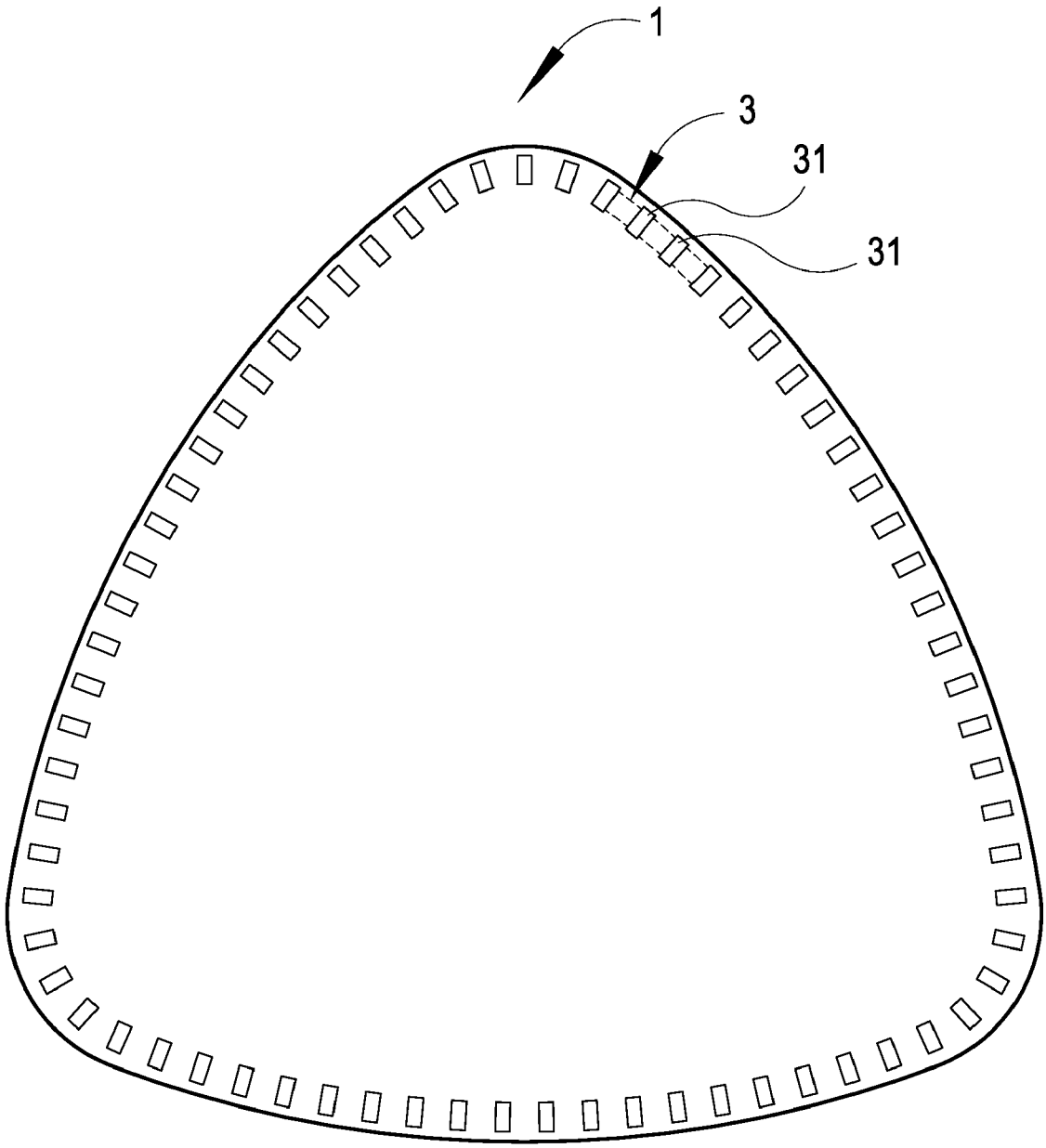
FIG. 3 is a schematic view of a secured bra pad.

A schematic view of a secured bra pad is provided in FIG. 3. The silicone gel layer 11, second thermoplastic polyurethane (TPU) film 12, and cloth layer 13 are stacked up together and sewed at edge to form a secured bra pad structure 1. Because the silicone gel layer 11 and the second thermoplastic polyurethane (TPU) film 12 are only sewed together at the edge, there is a first space 14 formed between the silicone gel layer 11 and second thermoplastic polyurethane (TPU)

film 12 and a second space 15 formed between the second thermoplastic polyurethane (TPU) film 12, and cloth layer 13.

Figure 4:
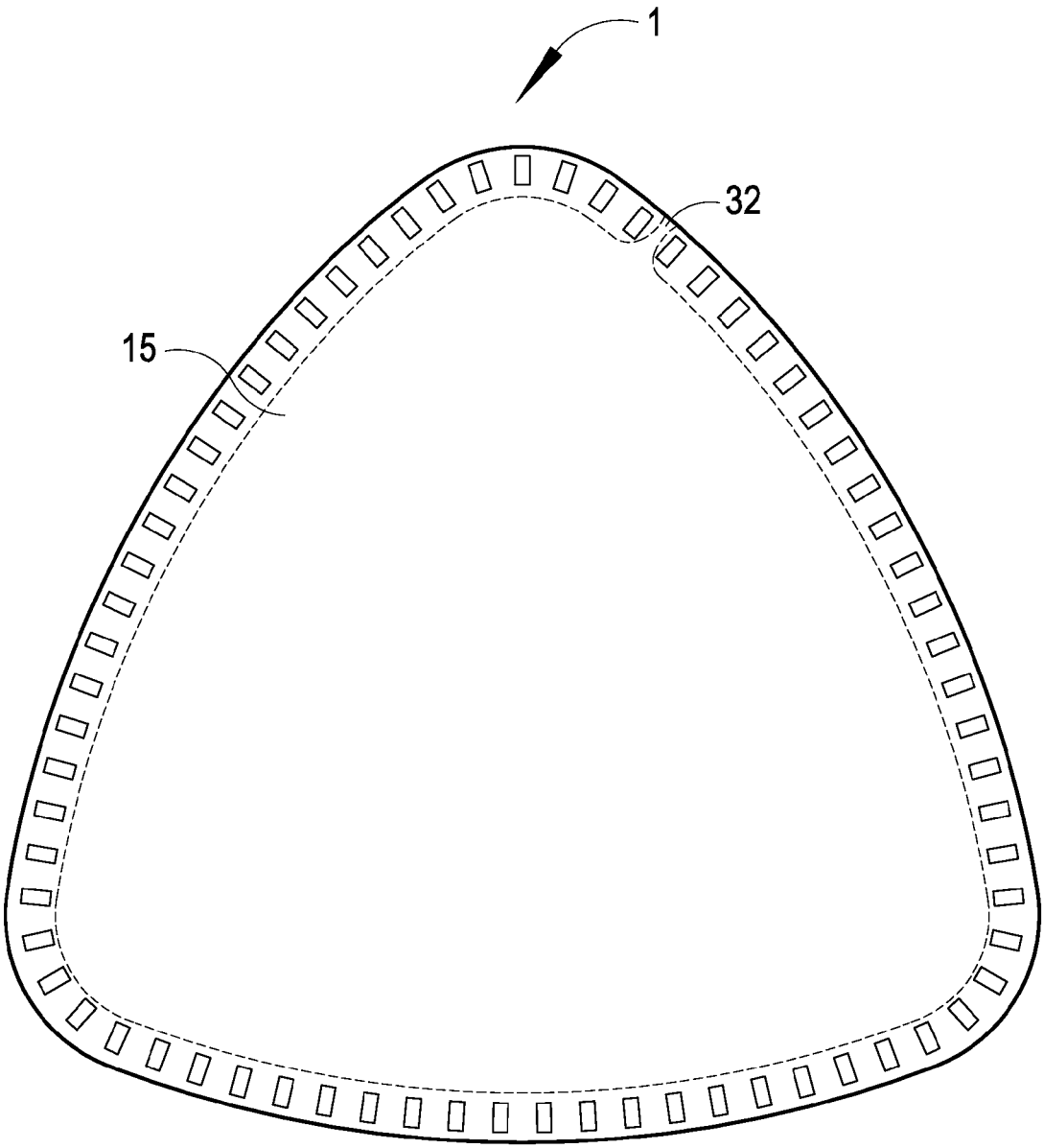
FIG. 4 is a schematic view of the bra pad showing the air flowing path.

A front view of a secured bra pad structure is provided in FIG. 4. Since the bra pad structure 1 is secured by sewing, the air inside the first space 14 and second space 15 is able to flow through the gaps 32 between stitches 31 to the open space to improve the breathing capability and the heat-dissipating capability.

Figure 2:
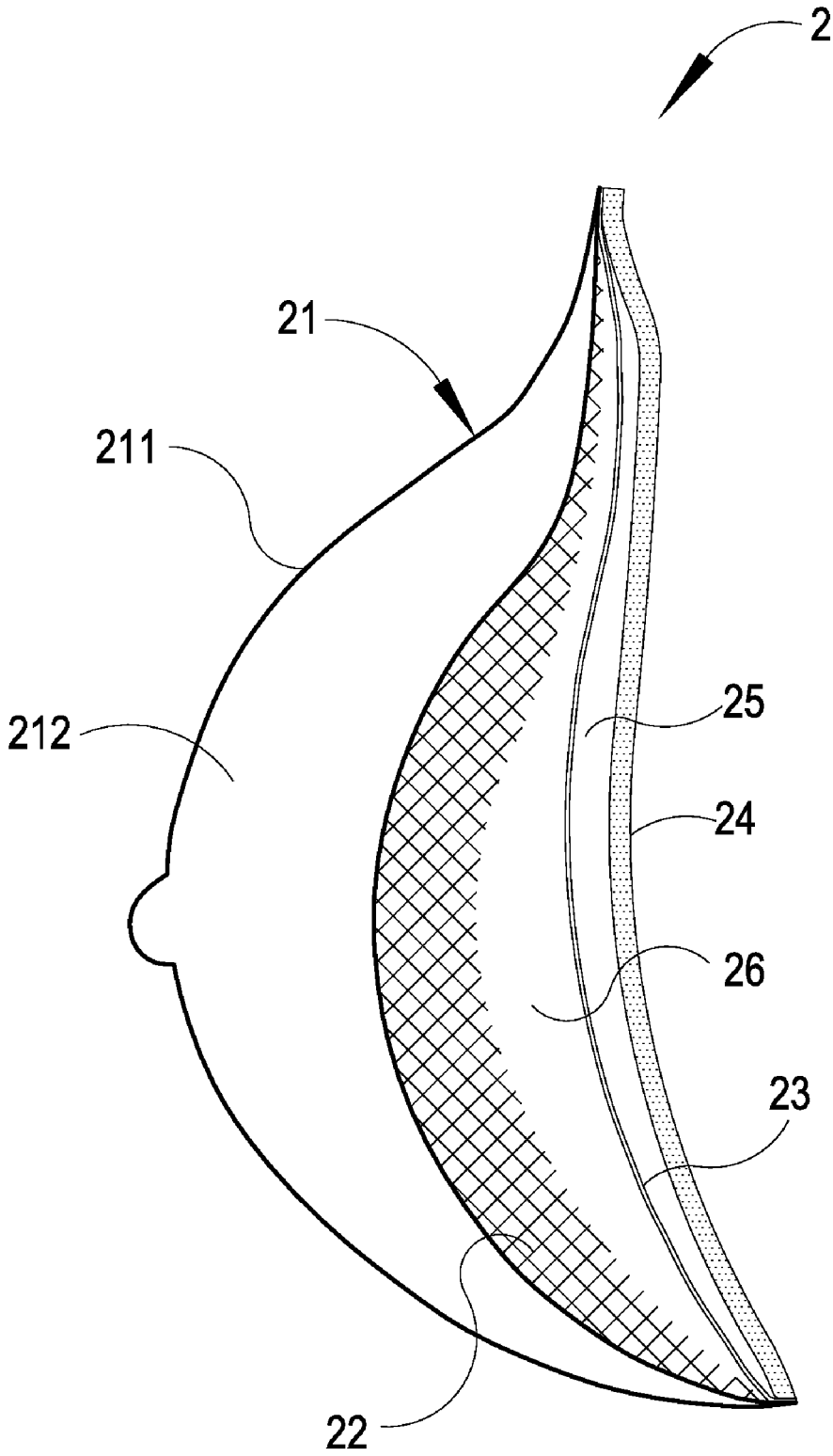
FIG. 2 is a schematic, exploded view of a bra pad of a second preferred embodiment of the present invention.

A second embodiment of the bra pad is showed in FIG. 2. The bra pad structure 2 includes: a silicone gel layer 21, a lightweight material layer 22, a second thermoplastic polyurethane (TPU) film 23 and a cloth layer 24. The silicone gel layer 21 is manufactured by making silicone gel material 212 enclosed by a first polyurethane (TPU) film 211. The silicone gel material 212 may be liquid-state silicone gel, liquid-state silicone rubber, or silicone gel material filling hollow microspheres therein. The silicone gel layer 21 is manufactured to be a concave cup. Between the silicone gel layers 21 and the second thermoplastic polyurethane (TPU) film 23, a first space 26 is formed and between the second thermoplastic polyurethane (TPU) film 23 and cloth layers 24, a second space 25 is formed. Due to the fact that the silicone gel layer 21 is semi-secured on the edge of the cloth layers 24 to form the bra pad structure, the air will be able to circulate from inside the first and second space 25, 26 to open space. The present bra pad employs the silicone gel layer 21 to enhance the softness and comfort. With the first and second space 25, 26 between the second thermoplastic polyurethane (TPU) films 23, and silicone gel layers, the bra pad has effective breathing capability and heat-dissipating capability. The lightweight material layer 22 is placed in the first space 26. The cloth layer 24 is placed next to one side of the second thermoplastic polyurethane (TPU) film 23. The silicone gel layer 21, the lightweight material layer 22, the second thermoplastic polyurethane (TPU) film 23, and the cloth layer 24 are stacked up together and sewed at edge to form a secured bra pad structure 2. Because the cloth layer 24 and the second thermoplastic polyurethane (TPU) film 23 are only sewed together at the edge, there is a space 25 formed between the cloth layer 24 and the second thermoplastic polyurethane (TPU) film 23.

A front view of a secured bra pad structure is provided in FIG. 4. Since the bra pad structure is secured by sewing, the air inside the space 25 is able to flow through the gaps 32 between stitches 31 to the open space to improve the breathing capability and the heat-dissipating capability.

Comparing with the conventional arts, the bra pads of the present invention have the following advantages:

1. The bra pads of the present invention can effectively resolve the breathing capability and heat-dissipating capability problem when the users carry the bra pads of the present invention for a long time or in sports.
2. The bra pads of the present invention can lighten the weight of the bra pad and enhance the softness and comfort with excellent touch. Furthermore, the bra pads of the present invention can make the whole cup elasticity. Specific gravity, and active feeling thereof fit with the skin of people, to make the users more comfortable.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A bra pad comprising:

a silicone gel layer including silicone gel material and a first thermoplastic polyurethane (TPU) film and in a form of a concave cup, wherein the first thermoplastic polyurethane (TPU) film encloses the silicone gel material;

a second thermoplastic polyurethane (TPU) film located next to the silicone gel layer; and a cloth layer located next to the second thermoplastic polyurethane (TPU) film;

wherein the second thermoplastic polyurethane (TPU) film is located between the silicone gel layer and the cloth layer; the silicone gel layer, the second thermoplastic polyurethane (TPU) film, and the cloth layer are stacked up together and secured to form a secured bra pad structure; a first space is formed between the silicone gel layer and the second thermoplastic polyurethane (TPU) film and a second space is formed between the second thermoplastic polyurethane (TPU) film and the cloth layer; by the secured bra pad structure, air inside the first space and second space is able to flow to the open space to improve breathing capability and heat-dissipating capability.

2. The bra pad as claimed in claim 1, wherein the silicone gel material is selected from a group consisting of liquid-state silicone gel, liquid-state silicone rubber, and a silicone gel material filling hollow microspheres therein.

3. The bra pad as claimed in claim 1, wherein the secured bra pad structure is secured by sewing.

4. The bra pad as claimed in claim 1, wherein the cloth has a surface contacting with skin of a user, which lays adhesive silicone gel thereon to make the bra pad have self-adhesive capability.

* * * * *